United States Patent [19]

Cramer

[11] 4,388,852

[45] Jun. 21, 1983

[54] DULCIMER CONSTRUCTION

[76] Inventor: Roderick L. Cramer, c/o The Beriyth Co., P.O. Box 330, 1035 N. Fourth St., Wytheville, Va. 24382

[21] Appl. No.: 292,661

[22] Filed: Aug. 13, 1981

[51] Int. Cl.[3] ..... G10D 3/00

[52] U.S. Cl. ..... 84/284; 84/285; 84/291

[58] Field of Search ..... 84/173, 284–291

[56] References Cited

U.S. PATENT DOCUMENTS 294,832 3/1884 Wichard ..... 84/285

466,878 1/1892 Buckner ..... 84/285

808,374 12/1905 James ..... 84/284

3,302,507 2/1967 Fender ..... 84/291 X

*Primary Examiner*—Lawrence R. Franklin

*Attorney, Agent, or Firm*—W. Brown Morton, Jr.

[57] ABSTRACT

A dulcimer constructed primarily of wood, wherein the traditional heavy internal wood bracing structure, which is parallel to, and resists the compressive force of, the tuned strings and is connected to the back panel, is replaced by light metallic bracing, of tubular or other suitably engineered cross-section, which is also parallel to, and resists the compressive force of, the tuned strings, but is not in contact with the back panel.

3 Claims, 5 Drawing Figures

DULCIMER CONSTRUCTION

BACKGROUND OF THE INVENTION

1. Field of the Invention

This invention relates to an improved construction of the dulcimer and, in particular, to improvements of its basic frame work and internal bracing structure.

2. Description of the Prior Art

The dulcimer is a percussion stringed musical instrument of ancient lineage. It consists essentially of a series, or plurality of series, of tuned, taut strings arranged across a sounding board and supported on it by bridges. It is played by striking the appropriate strings with hand-held hammers. It may be regarded as a portable, keyboardless small piano, is similar in tone to a piano, and, indeed is sometimes called a "Lumberjack's Piano".

Dulcimers of this sort are generally known wherein the basic framework and internal bracing structure of the musical instrument is comprised of either a completely wooden frame or a metal frame.

The conventional dulcimer is one wherein the basic framework and internal bracing structure is made entirely of wood. The internal bracing to resist the compressive force of the tuned strings is accomplished by wooden struts parallel to the strings fastened both to the frame side blocks and to the back panel of the musical instrument. This sort of dulcimer, however, suffers from tonal distortion problems because the internal struts break the soundbox volume into a number of closed compartments, thereby reducing resonance and volume, and altering the tone of string vibrations. Moreover, the wooden frame assembly is subject to such strong bending forces from the string tension that thick, heavy wood bracing is required. Relatively high material cost for such large hardwood parts and reduced portability are consequent disadvantages of this type dulcimer construction. A variation attempting to overcome these disadvantages is disclosed in U.S. Pat. No. 479,323 in which "skeleton" braces attached at converging angles to both back panel and sounding board are used.

U.S. Pat. Nos. 171,031, 440,601, 461,915, 571,645, 594,325, and 2,474,599 disclose variations of cast-iron metal frames utilized in dulcimer and similar musical instrument construction. This class of prior art dulcimers, however, suffers from reduced portability due to the use of a heavy cast-iron metal framework.

It is, therefore, an object of the present invention to provide a dulcimer which offers greatly improved resonance, volume, and tone through the use of generally tubular, metallic internal bracing so arranged in the combination with a wooden frame to provide a single large soundbox.

It is a further object of the present invention to provide a more portable and less expensive version of the dulcimer.

SUMMARY OF THE INVENTION

In accordance with the principles of the present invention, the above-stated and other objectives are accomplished in a dulcimer comprising a specially-fastened wooden outer framework braced internally by metal tubing parallel to the strings. The said metal bracing is in contact only with the sides of the instrument and therefore, a single large soundbox is formed which provides for greatly improved resonance, volume, and tone. The composite contruction thus provided retains the natural beauty of wood in the frame and back and sounding board, but is considerably lighter than a similar sized, all-wood instrument, thus enhancing portability.

BRIEF DESCRIPTION OF THE DRAWINGS

The above and other features and aspect of the present invention will become more apparent upon reading the following detailed description in conjunction with the accompanying drawings in which.

DETAILED DESCRIPTION

Figure 1:
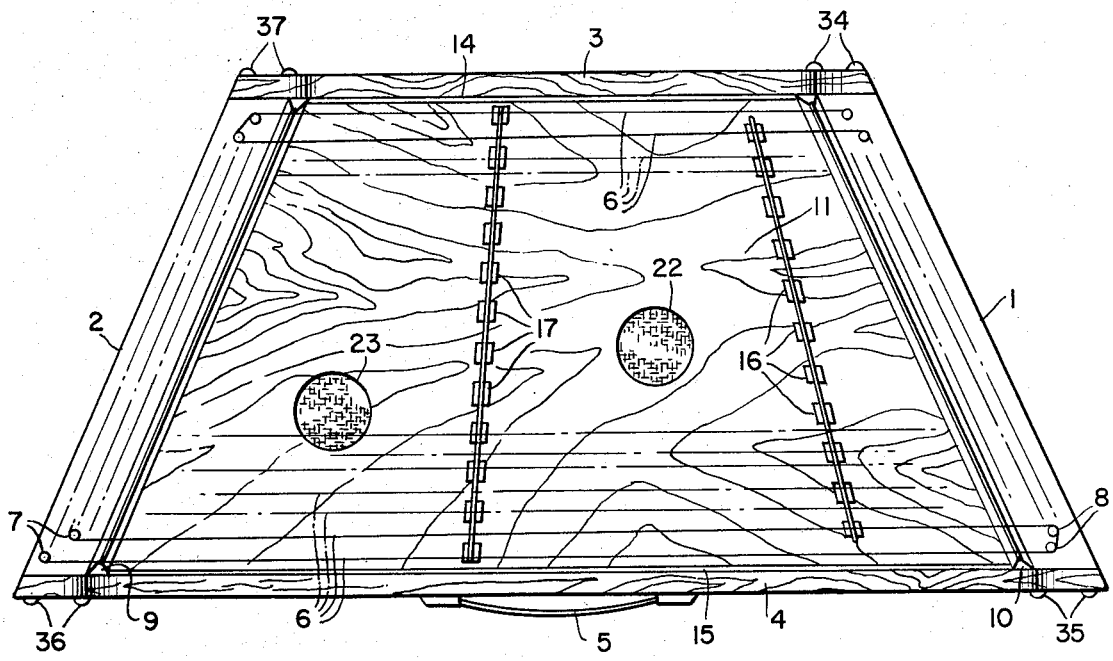
FIG. 1 is a perspective view of the top of an instrument embodying my improvements.

FIG. 1 presents in perspective the exterior appearance of a dulcimer in accordance with the invention. Little appears in FIG. 1 to differentiate it from the traditional wooden Appalachian "whamdiddle" which is a trapezoid-shaped musical instrument comprising a set of convergent pin blocks 1,2 made of maple and held apart by a short and a long cherry rail 3,4. The carrying handle 5 is attached to long rail 4. The strings 6 are carried by the pin blocks 1,2. In the instrument shown in FIG. 1, the strings 6 are anchored to fixed pins 7 in block 2 and are attached for winding on turning pins 8 rotatable about their axis in holes in block 1. Pins 8 are turned by a wrench or key (not shown) clockwise against friction which must be sufficient to resist unwinding by tension in the tuned string. The musical particulars of the tuning of a dulcimer form no part of the present invention. Suffice it to say that the combined tension of twelve treble and eleven bass string "courses" (groups of 2 or 3 identically tuned individual strings), for example, subjects the blocks 1,2 and rails 3,4 of the wooden frame to substantial stresses.

Figure 4:
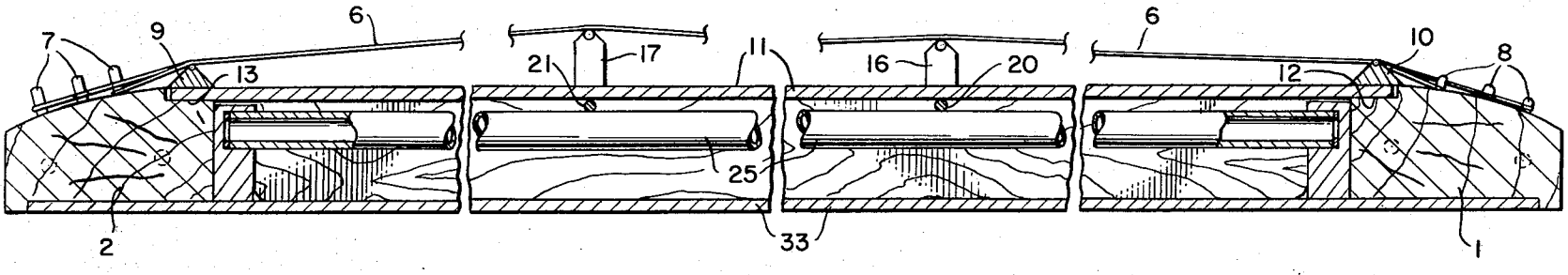
FIG. 4 is a vertical section taken on the line 4—4 in FIG. 3.

Bridge rails 9 and 10 elevate the strings 6 above the sounding board 11, and, by virtue, of the downward pressure imposed by string tension, hold the otherwise "floating" board 11 in place in recesses 12, 13 in pin blocks 1, 2 respectively, as best seen in FIG. 4. Spaces 14 and 15 separate the board 11 completely from short and long rails 3, 4. The strings 6 also rest on bridge blocks which in turn rest on board 11; the eleven bass courses on a series of blocks 16 and the twelve treble course on a series of blocks 17 arranged in two straight rows between bridge rails 9, 10 and appropriately spaced from them to provide the desired musical turning.

Figure 3:
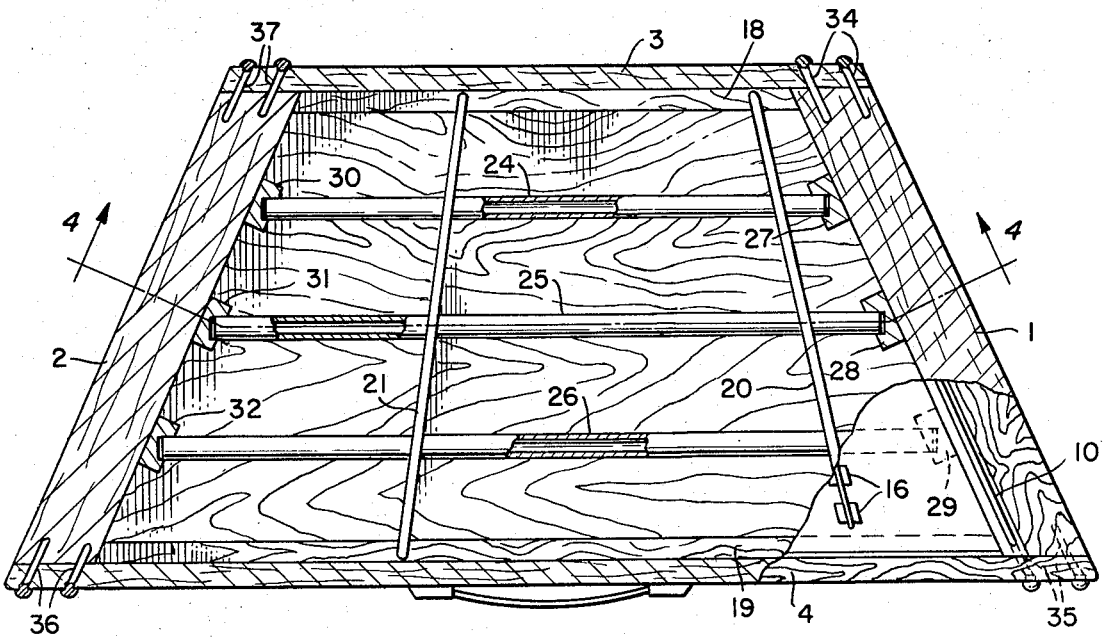
FIG. 3 is a plain view, partially in section, taken on the line 3—3 in FIG. 2.

As shown in FIG. 3, the inside wall of rails 3,4 are provided with so-called glue blocks 18, 19 on which transverse steel rods 20,21 rest. Rods 20, 21 are so positioned and the glue blocks so proportioned that the tops of the rods 20, 21 are in the plane of the bottoms of the recesses 12, 13 in the pin blocks 1,2 and the rows of bridge blocks 16, 17 are directly above the rods 20,21 respectively, with the floating soundboard 11 supported by the rods 20, 21 which are, in turn, held in place on glue blocks 18, 19 only by the downward pressure of the tension on strings 6. Stated another way, if the strings 6 are removed from the instrument, the bridge rails 9, 10, the bridge blocks 16, 17, the board 11, and the rods 20, 21 can be simply lifted off as they are held in place only by string tensions. The holes 22, 23 in the soundboard 11 are located roughly at the two maximum unsupported points of the soundboard.

Figure 2:
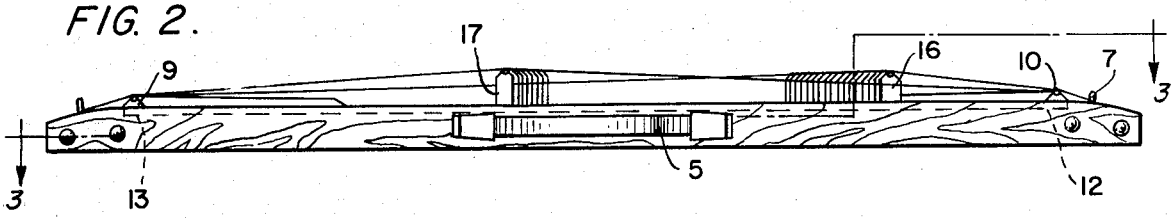
FIG. 2 is an elevation of the wide end of the instrument shown in FIG. 1.
Figure 5:
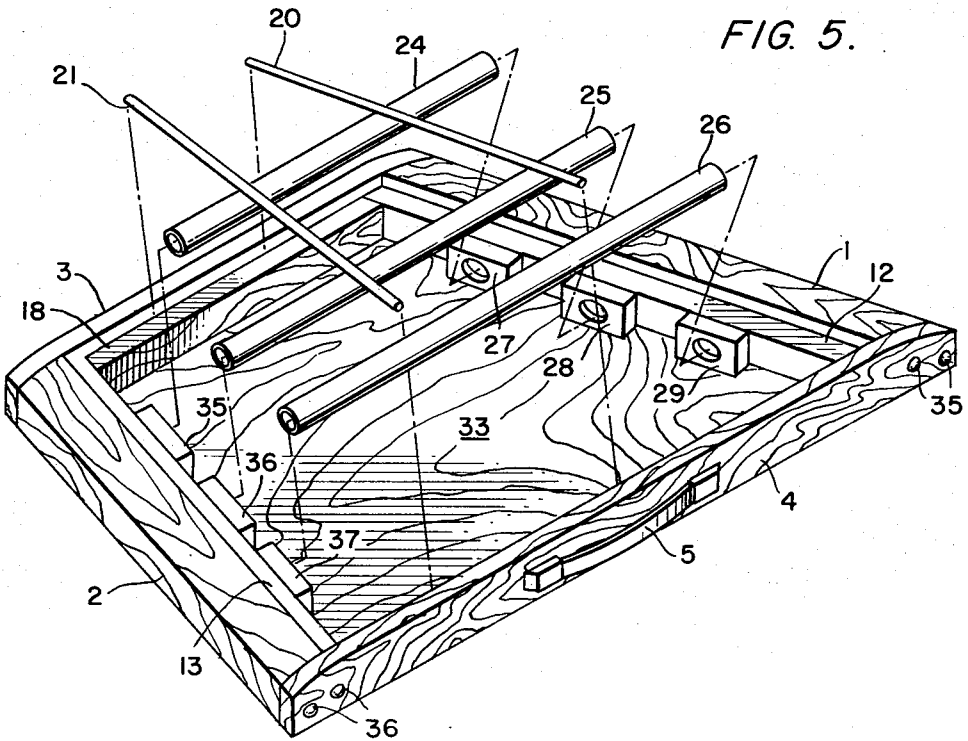
FIG. 5 is a perspective view of an instrument in course of assembly with the stringing and the sounding board not yet in place.

When the strings 6 are struck, the soundboard 11 flexes in response to the string vibration. Neither the precise diameter of the holes 22, 23 is critical, but, by trial and error, the somewhat assymmetrical location shown seems preferable. As can be best appreciated from FIG. 2, the tension on the strings 6 subjects the pin blocks 1, 2 to substantial forces drawing them together and also tending to rotate their outer edges upward and inward. As shown in FIGS. 3, 4, and 5, it is a key feature of the invention to provide a novel bracing arrangement to resist the forces drawing the pin blocks 1, 2 together. This arrangement comprises the three metal tubes 24, 25, 26 which are parallel to the strings. While shown as right circular cylinders and, for economy, preferably cut from common steel electrical conduit, they could be suitably shaped extrusions or box section members. The ends of the tubes 24, 25, 26 are supported on pin blocks 1,2 by socket blocks 27, 28, 29, 30, 31 and 32. Common steel flat washers are placed in the socket blocks to take the thrust of the ends of tubes 24, 25, 26. The centers of the sockets on blocks 27, 28, 29, 30, 31, and 32 are in a common plane so located with reference to the plane of the tops of the glue blocks 18, 19 that the rods 20, 21 are held above, but in contact with the top surfaces of tubes 24, 25, 26. The socket blocks are glued to the back panel 33 as well as to pin blocks 1,2. This arrangement and the approximately 1/16" clearance between the edges of the floating board 11 and the outer walls of recesses 12, 13 are clearly seen in FIG. 4. In assembly of the instrument, because of the divergence of pin blocks 1, 2, short tube 24 can be readily placed in socket blocks 27, 30; tube 25, in socket blocks 28, 31; and tube 26, in socket blocks 29, 32.

While the tubing braces 24, 25, 26 serve perfectly to prevent pin blocks 1, 2 from being flexed inward toward one another, their location tends to accentuate the tendency before described, for the pin blocks 1, 2 to rotate. It has been found necessary to provide special frame fastening means to prevent this rotation. For this purpose, four pairs of $\frac{3}{8}$" steel dowel pins 34, 35, 36, 37 fasten the pin blocks 1, 2 to the side rails 3, 4.

From the point of view of tone quality, it is important to note that the tubing braces 24, 25,26 are connected to the outer frame only at the socket blocks 27, 28, 29, 30, 31, 32. When the strings are placed in vibration, the braces 24, 25, 26 are free to flex in response over their full length. Since the metal tubes 24, 25, 26 do not absorb or dampen the sound waves, they vibrate until the wave is transferred into the body wood at the ends of the support braces. The overall effect is a relatively quick transfer of the harmonics to the body wood, resulting in a high volume initially with dampening occurring quickly enough not to interfere with the next note to be struck.

I claim:

1. In a dulcimer comprising two divergent pin blocks, two side rails connecting the ends of one pin block to the corresponding ends of the other pin block, a back panel secured around its periphery to both pin blocks and both side rails, anchor pins in one pin block, turning pins in the other pin block, and tuned strings under substantial tension running from anchor pins to tuning pins, the improvement comprising a plurality of metal braces running from pin block to pin block parallel to the strings and out of contact with the back panel, an anti-rotational fastening structure at each end of each side rail whereby each pin block is held against uupward and inward rotation under influence of string tension, a floating sounding board with opposite ends supported in recesses in the upper inner edge of the pin blocks, two bridge rails over said board supporting the strings and holding the board in the recesses, two rows of bridge blocks supporting the strings atop the board and intermediate the bridge rails, and two rods, one beneath each of said rows, each with its top surface in contact with the board and carried by the braces.

2. In a dulcimer adapted to be played without additional bracing such as a case comprising two divergent pin blocks, two side rails connecting the ends of one pin block to the corresponding ends of the other pin block, a back panel secured around its periphery to both pin blocks and both side rails, anchor pins in one pin block, tuning pins in the other pin block, tuned strings under substantial tension running from anchor pins to tuning pins, a sounding board spaced from said back panel by means carried by said pin blocks and side rails, and bridges resting on said board intermediate said blocks supporting said strings, the improvement comprising a plurality of lightweight metal braces running from pin block to pin block parallel to the strings and out of contact with the back panel, an anti-rotational fastening structure at each end of each side rail, whereby each pin block is held against upward and inward rotation under influence of string tension, and a metal rod lying under each bridge between the board and the braces.

3. A dulcimer according to claim 2 in which the ends of the braces are inserted in socket blocks carried on the inside of each pin block.

* * * * *